US006501385B1

(12) United States Patent
O'Quinn

(10) Patent No.: US 6,501,385 B1
(45) Date of Patent: Dec. 31, 2002

(54) GROUND BUZZER

(76) Inventor: Bruce C. O'Quinn, 130 Turtle Creek La., Sanford, NC (US) 27330

( * ) Notice: Subject to any disclaimer, the term of this patent is extended or adjusted under 35 U.S.C. 154(b) by 0 days.

(21) Appl. No.: 09/916,887

(22) Filed: Jul. 26, 2001

(51) Int. Cl.[7] ..... G08B 21/00
(52) U.S. Cl. ..... 340/649; 340/687; 340/692; 340/693.9
(58) Field of Search ..... 340/684, 685, 340/649, 687, 692, 693.9

(56) References Cited

U.S. PATENT DOCUMENTS 4,243,118 A * 1/1981 Landry
5,159,523 A * 10/1992 Claassen et al. ..... 340/649
5,261,514 A * 11/1993 Evans

* cited by examiner

*Primary Examiner*—Daniel J. Wu
(74) *Attorney, Agent, or Firm*—Joseph N. Breaux

(57) ABSTRACT

A safety mechanism for alerting power line workers of the failure to properly connect a grounding wire to a neutral wire. The grounding buzzer automatically provides an audible and/or visual output when disconnected from a storage location and continues to provide the alarm until it is properly installed. An alarm is optionally installed on both the connecting hook and the vehicle to alert as many individuals as possible to the failure to properly connect the grounding wire.

2 Claims, 2 Drawing Sheets

GROUND BUZZER

TECHNICAL FIELD

The present invention relates to safety equipment and more particularly to safety equipment used by power line workers that includes a buzzer assembly integrally formed with a grounding wire assembly; the buzzer assembly is automatically activated when the grounding wire attachment hook is disconnected from the truck and which sounds an audible alarm until an electrical contact is made between the hook and the neutral line of a power distribution network; a second buzzer can be physically attached to the truck to that the worker near the hook as well as adjacent to the truck would be alerted to the status of the grounding wire attachment hook.

BACKGROUND OF INVENTION

Each year workers are electrocuted or otherwise injured because of a failure to properly connect the grounding wire to the neutral wire. It would be a benefit, therefore, to have a grounding wire which would automatically provide an audible and/or visual output when disconnected from its storage location and which would continue to provide the audible alarm until it was properly installed on the neutral wire of a distribution line.

SUMMARY OF INVENTION

It is thus an object of the invention to provide a ground buzzer that includes a buzzer assembly integrally formed with a grounding wire assembly; the buzzer assembly is automatically activated when the grounding wire attachment hook is disconnected from the truck and which sounds an audible alarm until an electrical contact is made between the hook and the neutral line of a power distribution network; a second buzzer can be physically attached to the truck to that the worker near the hook as well as adjacent to the truck would be alerted to the status of the grounding wire attachment hook.

Accordingly, a ground buzzer is provided. The ground buzzer includes a buzzer assembly integrally formed with a grounding wire assembly; the buzzer assembly is automatically activated when the grounding wire attachment hook is disconnected from the truck and which sounds an audible alarm until an electrical contact is made between the hook and the neutral line of a power distribution network; a second buzzer can be physically attached to the truck to that the worker near the hook as well as adjacent to the truck would be alerted to the status of the grounding wire attachment hook.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY EMBODIMENTS

Figure 1:
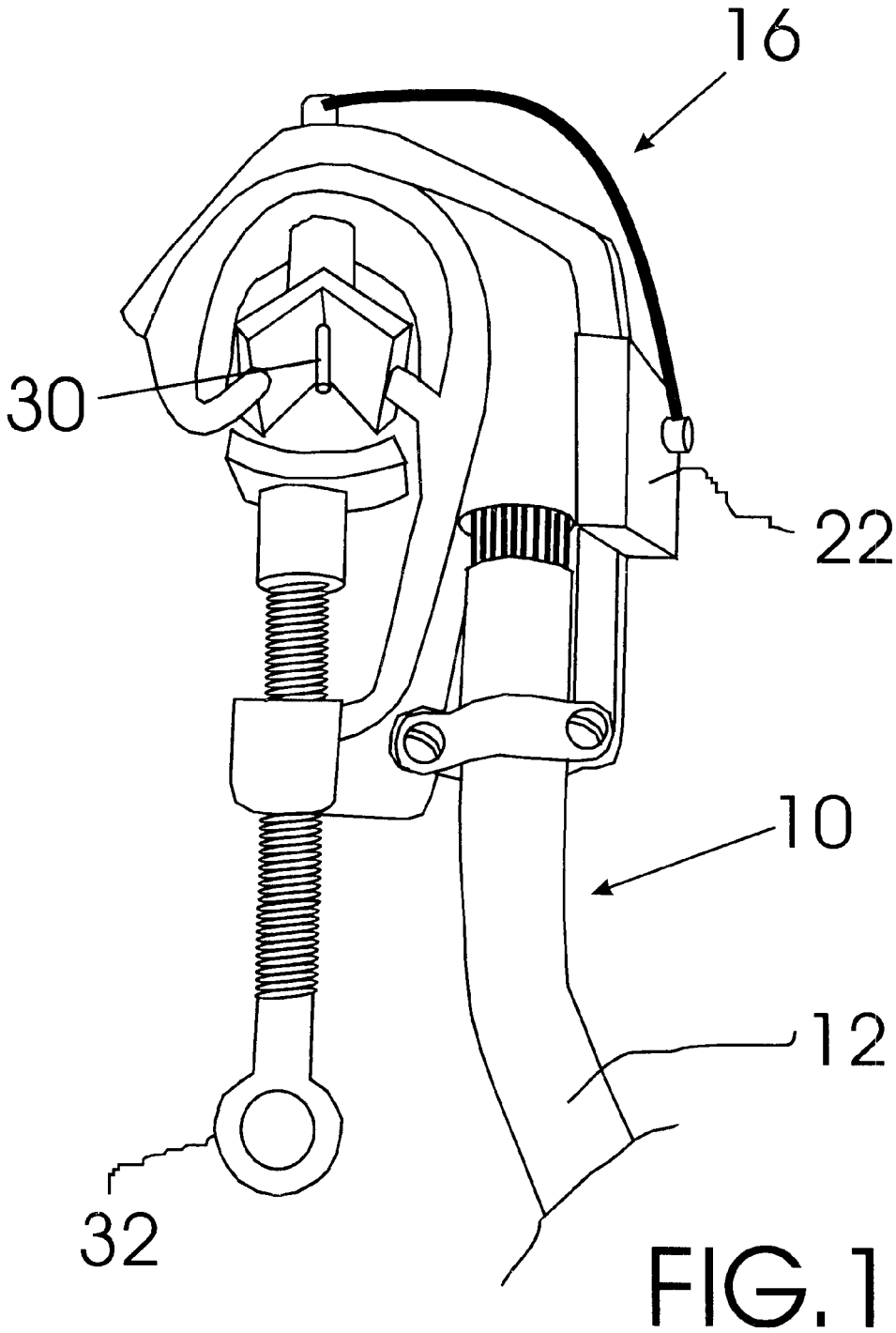
FIG. 1 shows an exemplary embodiment of the connecting hook end of the ground buzzer of the present invention.
Figure 2:
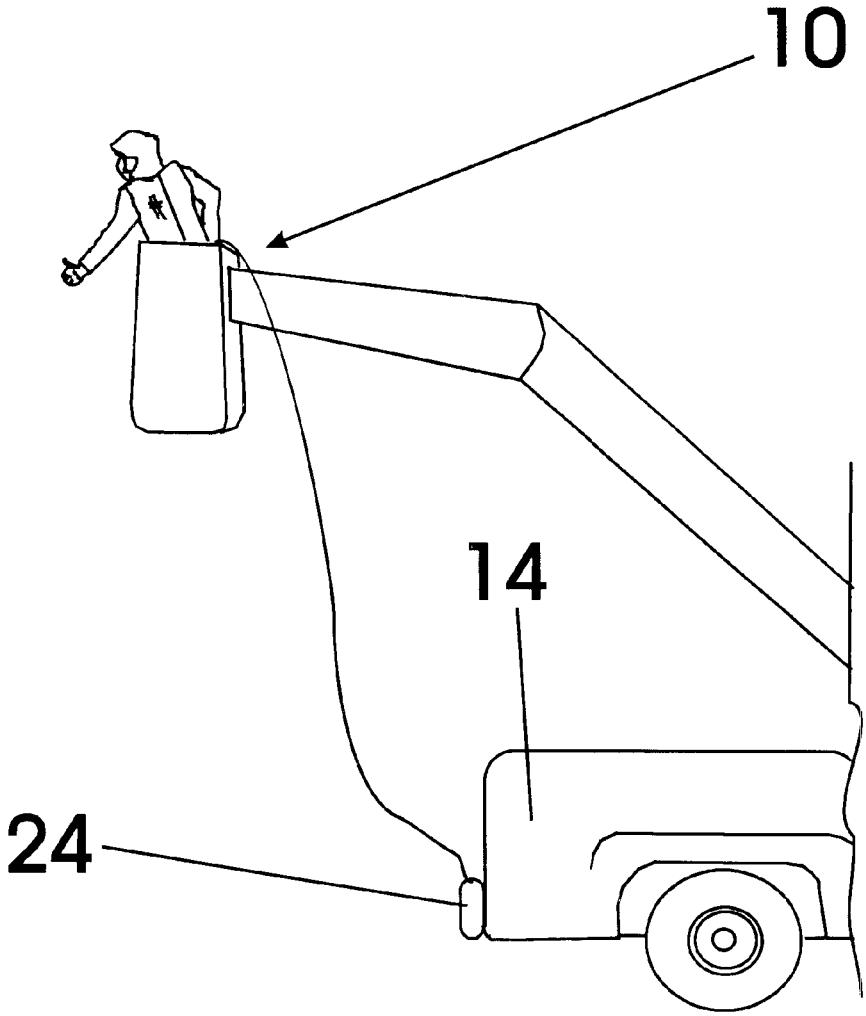
FIG. 2 is a second view of the ground buzzer showing the truck level beeper.

FIGS. 1 and 2 show various aspects of an exemplary embodiment of the ground buzzer of the present invention generally designated 10. Ground buzzer 10 is an electrical conductor conducting wire 12 that is used to connect a vehicle 14 to the neutral line of a power distribution network using a clamp generally designated 16. In this embodiment ground buzzer 10 includes two buzzer units 22, 24 wherein one buzzer unit 22 is mounted to the neutral connecting hook and the second buzzer unit 24 is mounted to the truck. Buzzer units 22 and 24 are activated once hook 16 is removed from storage on truck 14 and is not deactivated until a button 30 is depressed by physical contact with the neutral line of a power distribution network and held in place by operation of a thumbscrew assembly 32.

It can be seen from the preceding description that a ground buzzer has been provided.

It is noted that the embodiment of the ground buzzer described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A ground buzzer safety device for power line workers working on or from a truck having a grounding wire attachment hook for grounding the truck that is stored in electrical connection with the truck when not in use as a grounding wire connected to a neutral electrical power line to safely ground the truck; the ground buzzer comprising:

a first audible buzzer sound generating assembly integrally formed with a grounding wire assembly having a grounding wire attachment hook;

the first audible buzzer sound generating assembly being automatically activated when the grounding wire attachment hook of is disconnected from a connection fitting of the audible buzzer sound generating assembly mounted on the truck;

the first audible buzzer sound generating assembly being carried adjacent the grounding wire attachment hook and sounding an audible alarm when activated until an electrical contact is made between the grounding wire attachment hook and a neutral power line of a power distribution network.

2. The ground buzzer safety device of claim 1 further comprising:

a second audible buzzer sound generating assembly carried on the truck and sounding a second audible buzzer sound simultaneously with the audible alarm of the first audible sound generating assembly in a manner to alert personnel near the truck that an unsafe, ungrounded truck condition is present;

the second audible buzzer sound generating assembly sounding the second audible buzzer sound until an electrical contact is made between the grounding wire attachment hook and a neutral power line of a power distribution network.

* * * * *